United States Patent [19]

Fischman

[11] Patent Number: 4,712,700

[45] Date of Patent: Dec. 15, 1987

[54] TAMPER RESISTANT BOTTLE

[76] Inventor: Harry H. Fischman, 9436 Kostner Ave., Skokie, Ill. 60076

[21] Appl. No.: 937,078

[22] Filed: Dec. 2, 1986

[51] Int. Cl.[4] ..... B65D 55/02; B65D 53/04

[52] U.S. Cl. ..... 215/366; 215/263; 215/31; 215/1 C

[58] Field of Search ..... 215/263, 31, 1 C, 365, 215/366

[56] References Cited

U.S. PATENT DOCUMENTS

| | | | |
|---|---|---|---|
| 579,867 | 3/1897 | Fenn | 215/31 |
| 809,258 | 1/1906 | Herrington | 215/365 |
| 870,312 | 11/1907 | Parker | 215/365 |
| 931,216 | 8/1909 | Phillips | 215/365 |
| 1,070,516 | 8/1913 | O'Brien | 215/1 C |
| 2,030,618 | 2/1936 | Whitney | 215/263 X |
| 3,080,990 | 3/1963 | Parkinson et al. | 215/31 |
| 4,429,803 | 2/1984 | Butterfield | 215/366 |

FOREIGN PATENT DOCUMENTS

| | | | |
|---|---|---|---|
| 1192519 | 4/1959 | France | 215/1 C |
| 1322186 | 2/1963 | France | 215/1 C |
| 534594 | 10/1955 | Italy | 215/1 C |
| 2132978 | 7/1984 | United Kingdom | 215/1 C |

*Primary Examiner*—William Price

[57] ABSTRACT

The present invention provides a tamper resistant bottle to prevent and deter persons from injecting contaminated substances into bottles containing liquids, from removing the solid contents of the bottle, changing their composition, replacing the contents back into the bottle and restoring the bottle to its original condition so as to appear untouched, for the purpose of doing harm to another person. The tamper resistant bottle whose aperature or mouth is generally narrower than its vertical sides, has a safety seal permanently attached within the bottle at some point below the mouth. The safety seal is so attached inside the bottle, that it is beyond the reach and manipulations of anyone; therefore, if broken, the safety seal cannot be replaced, repaired or repositioned in its original form and condition.

7 Claims, 9 Drawing Figures

TAMPER RESISTANT BOTTLE

BACKGROUND OF THE INVENTION

In recent years, a threat to packaging safety has appeared. Bottles of over the counter medicinal capsules have been deliberately opened, poison inserted into them, repacked in their original condition, and placed back on the shelves where innocent people purchased them, ingested them, and as a result have died. This has caused havoc in the market place.

Because of this, whenever a call is received of a poison threat, the products involved, have been withdrawn from the market, and refunds given to purchasers of the product. Since the tampered products have been in capsule form, caplets have been introduced in some cases, as a substitute for the capsules, in the hope of preventing the tampering. Packages and containers have been designed with so called safety seals that cover the mouth of the bottle, completely glued boxes, and new and more secure overwraps. All of this has been done at a very high cost to the manufacturers.

Unfortunately, none of the safety measures taken thus far have prevented, or will prevent more poisoning and killing. It can be shown that caplets can be tampered with as easily as capsules; all of the safety measures currently added to the packaging have a common flaw, they are all accessible to the tamperer, what he can reach and handle, he can remove and replace, therefore, unless the contents are tested, the tainted packages will never be noticed.

To overcome these shortcomings, the present invention is developed, to produce a container, with a safety seal that is inaccessible to the tamperer, and that will indicate with absolute certainty of any attempt whatsoever to tamper with the contents therein.

SUMMARY OF THE INVENTION

The present invention is a device in a container, that, if an attempt is made surreptitiously to gain access to the contents of the container, the device will indicate to the purchaser of the container that the attempt had been made.

To achieve this purpose, the invention includes a bottle or container molded in sections, one section having a male attaching configuration, the other section having a female attaching configuration, enabling the sections to be frictionally attached and bonded, each to the other. A safety seal is positioned in the upper section and the contents of the bottle are placed in the lower section, so that when the sections are frictionally attached and bonded, a completely filled bottle with the contents inside protected by a permanent non-replacable barrier will be created.

This invention has for its primary object, to create a container of such characteristics, so as to deter anyone from attempting entry to the container contents for the purpose of inflicting harm.

Another object of the invention, is to give to the purchaser instant visual notice that an attempt has been made to gain entry to the contents of the container.

Still another object of the invention, is to provide the manufacturers of the products, a device which will save them enormous sums in litigation, recall and replacement costs.

Various other features, objects and advantages of the present invention will become obvious to those skilled in the art upon reading the disclosures set forth hereinafter.

BRIEF DESCRIPTION OF THE DRAWINGS

Referring now to the drawings, which only show one example of a tamper resistant bottle in accordance with the present invention in which.

DETAILED DESCRIPTION OF THE INVENTION

Figure 1:
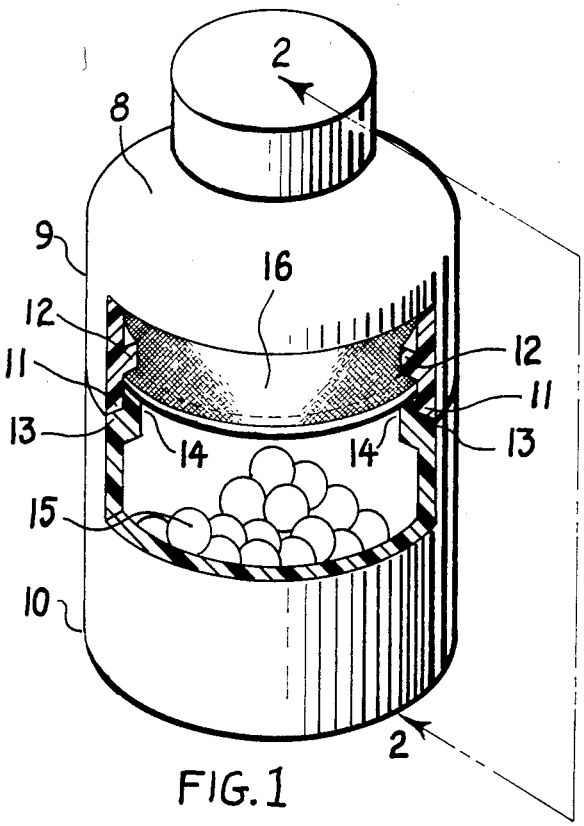
FIG. 1 is a perspective view partly in section of a tamper resistant bottle in accordance with the present invention.

Referring to the drawing shown in FIG. 1, numeral 8 designates the tamper resistant bottle, consisting of, but not limited to two sections, an upper section 9 and a lower section 10, upper section 9 comprising a peripheral attaching edge 11, and a internal shoulder projection 12. Lower section 10 comprising a peripheral attaching edge 13, an internal shoulder projection 14 and is the receptacle for the bottle contents 15. Positioned between and abutting shoulder projection 12 and shoulder projection 14 lies the safety seal 16.

Figure 2:
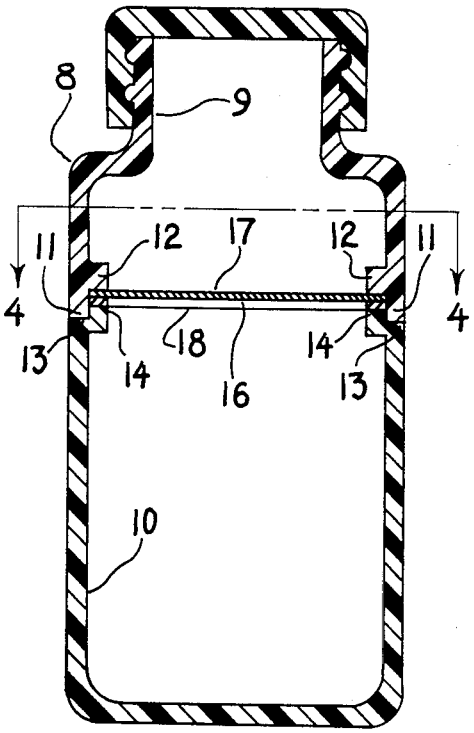
FIG. 2 is a vertical sectional view taken along line 2—2 of FIG. 1.

FIG. 2 shows the safety seal 16, comprising a seal body 17, a seal rim 18 permanently attached to seal body 17, and abutting the internal shoulder projections 12 and 14, said safety seal 16 being frictionally attached and bonded inside tamper resistant bottle 8.

Figure 3:
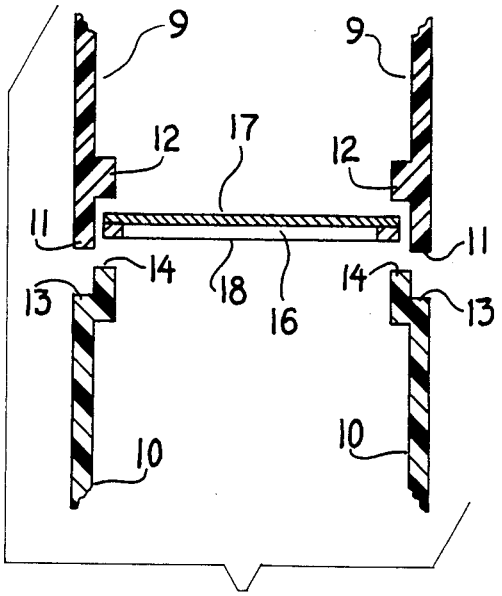
FIG. 3 is an exploded sectional view of the bottle edge, shoulders and safety seal as shown in FIG. 2, showing the spacial relationship of said shoulders and said safety seal prior to attachment and bonding.

FIG. 3 shows the spacial relationship of the safety seal 16 to the bottle sections 9 and 10 prior to bonding and packaging of bottle contents 15. In assembling and packaging the tamper resistant bottle 8, the bottle contents 15 as shown in FIG. 1 are placed in the lower section 10, safety seal 16 is then positioned abutting internal shoulder projection 12 or internal shoulder projection 14, it can be noted that safety seal 16 may be positioned and bonded to internal shoulder projection 12 anytime prior to the assembling and packaging of the tamper resistant bottle 8. Lower section 10 is now frictionally mated and bonded to upper section 9 at the peripheral attaching edges 13 and 11 respectively, at this juncture safety seal 16 is permanently positioned and bonded between internal shoulder projection 12 and internal shoulder projection 14.

Figure 4:
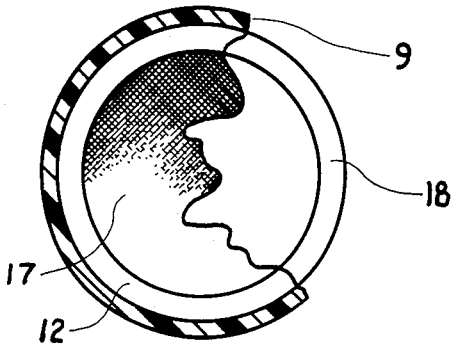
FIG. 4 is a horizontal sectional view with a broken out section of a permanently attached safety seal taken along line 4—4 of FIG. 2.

The safety seal body 17, composed of cloth material as shown in FIG. 4 is attached to rim 18. Rim 18 and that portion of the safety seal body 17 that is attached to it is the portion of safety seal 16 that is bonded to internal shoulder projection 12. It can be noted that paper, plastic, foil or other suitable material may also be used as the seal body 17, and in addition, said material may be bonded to internal shoulder projection 12 or internal shoulder projection 14 without using rim 18 if so desired. If rubber under tension is used as the safety seal body 17, it must be attached to rim 18 and then bonded to internal shoulder projections 12 and 14, if the rubber safety seal body 17 is punctured, it will separate completely in an explosive fashion.

Figure 5:
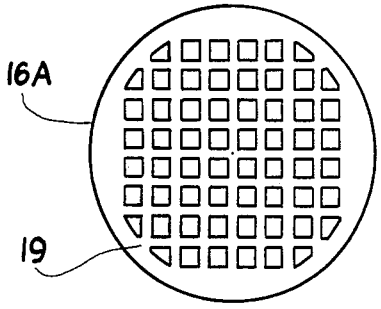
FIG. 5 is a front elevation view of a safety seal in an open mesh design.

FIG. 5 shows a modified form of the safety seal 16, this modified form shall be known as 16A, comprising a seal body 19 formed of a suitable, easily fracturable material in an open mesh, grid or other suitable configuration. Safety seal 16A as will be described hereinafter is of necessity smaller in diameter than safety seal 16, safety seal 16A is used in conjunction with safety seal 16 as a dual seal barrier inside the tamper resistant bottle 8 as pictured in FIG. 8.

Figure 8:
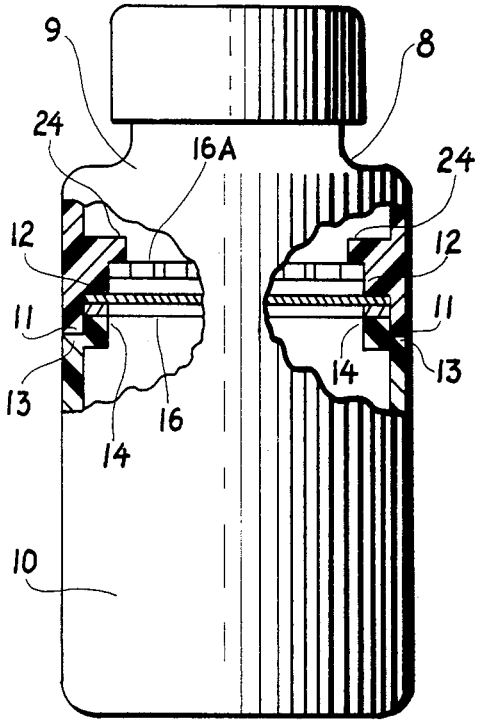
FIG. 8 is an elevation view of the tamper resistant bottle with broken out sections showing the positioning of a pair of safety seals within its interior.

In FIG. 8, tamper resistant bottle 8 comprises the upper section 9 and the lower section 10 in bonded relationship. Upper section 9 comprising internal shoulder projection 12 and internal shoulder projection 24 which is positioned above internal shoulder projection 12 and whose configuration is greater in width than internal shoulder projection 12. In assembling the tamper resistant bottle 8 pictured in FIG. 8, safety seal 16A being smaller in diameter than safety seal 16 is thrust beyond internal shoulder projection 12 and is positioned and bonded abutting internal shoulder projection 24, safety seal 16 is positioned and bonded to internal shoulder projection 12. Upper section 9 and lower section 10 are then frictionally mated and bonded to form a dual seal barrier in tamper resistant bottle 8, because safety seal 16A has an open mesh construction, the purchaser can see and check both seals.

Figure 6:
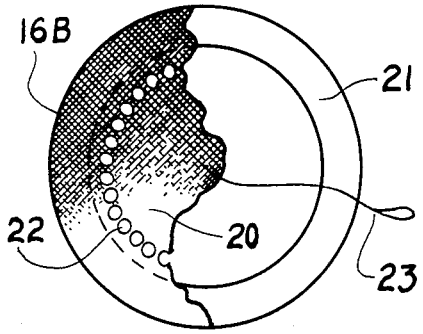
FIG. 6 is a front elevation view with a broken out section of a detachable safety seal.

FIG. 6 shows another modified form of safety seal 16. This modified form shall be known as 16B, comprising a seal body 20, a seal rim 21, perforations 22 located in seal body 20 and positioned in spaced relationship adjacent to seal rim 21; a pull tab 23, centered and attached to seal body 20. Safety seal 16B is attached and bonded to internal shoulder projections 12 and 14, in tamper resistant bottle 8 at the seal rim 21; when pull tab 23 is grasped and pulled, seal body 20 is detached from seal rim 21 at the perforations 22, and that portion of safety seal 16B, excluding the seal rim 21 which is bonded to internal shoulder projections 12 and 14, is withdrawn from tamper resistant bottle 8.

Figure 7:
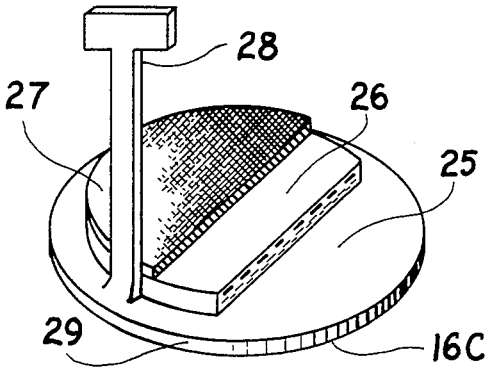
FIG. 7 is a perspective view partly in section of a multilayered seal which would be used to protect containers of liquid products.
Figure 9:
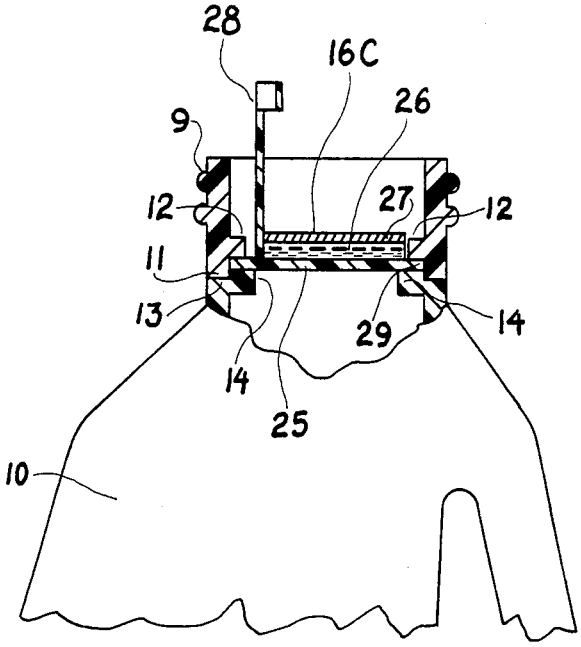
FIG. 9 is a front elevation view with a broken out section of the upper portion of a typical plastic container of milk, showing the placement of the multilayered seal described in FIG. 7.

FIG. 7 shows still another modification of safety seal 16. This modified form shall be known as 16C which is to be used in bottles that contain liquids. Safety seal 16C in the embodiment shown is a multilayered seal, comprising a bottom layer 25 of very thin plastic or other impervious material, and is larger in diameter than the other layers, a middle layer 26 containing a colored liquid, a top layer 27 composed of paper, cloth or other suitable liquid absorbing material, a pull tab 28 permanently attached, bonded or molded to bottom layer 25. Safety seal 16C is positioned inside and at the bottom portion of the neck of tamper resistant bottle 8, as shown in FIG. 9. Bottom layer 25 is permanently bonded to internal shoulder projection 12 and internal shoulder projection 14 at its rim portion 29, forming an impervious seal above the liquid contents. To remove safety seal 16C, bottom layer 25 is punctured by a pointed instrument between pull tab 28 and internal shoulder projection 12, pull tab 28 is then grasped and safety seal 16C can be pulled out of the neck of tamper resistant bottle 8. Safety seal 16C is constructed to prevent the injection of contaminated material into the liquid contents by piercing, if an attempt is made to pierce safety seal 16C, the middle layer 26 will rupture and the colored liquid it contains will stain the top layer 27, which will indicate that a tampering attempt has been made.

The disclosure of the invention described above represents the preferred embodiments of the invention: however, variations thereof, in the form, construction, and arrangement of the various components thereof and the modified application of the invention are possible without departing from the spirit and scope of the appended claims.

I claim:

1. A tamper resistant bottle, comprising a bottle or container of plastic or other suitable material, a first means adapted to form said bottle in, but not limited to, two sections, a second means to connect said sections, one to the other, a third means to permanently bond said connected sections, each to the other, said unit further including means adapted to form configurations and projections on the inside periphery of said tamper resistant bottle, to receive and to position one or more safety seals, bonding means to permanently bond said safety seals to said configurations and projections, in said tamper resistant bottle.

2. A tamper resistant bottle as described in claim 1 wherein said tamper resistant bottle receives and positions said safety seals within said tamper resistant bottle, at any configuration position below the rim of the mouth of said tamper resistant bottle, bonding means to permanently bond said safety seals to said configurations and projections within said tamper resistant bottle.

3. A safety seal as described in claim 1 comprising a seal body of foil, paper, cloth or other suitable fracturable material, means for bonding said seal body to said configurations and projections in said tamper resistant bottle.

4. A safety seal as described in claim 1 comprising a seal body, a seal rim, and means for bonding said seal rim to said seal body and thereto bonding said seal rim and said seal body to said configurations and projections in said tamper resistant bottle.

5. A safety seal as described in claim 1 comprising a seal body of an easily fracturable material, means adapted to form said seal body into an open mesh, grid or other suitable configuration, and means for bonding said seal body to said configurations and projections in said tamper resistant bottle.

6. A safety seal as described in claim 4 comprising a seal body, a seal rim, and further including perforations positioned in spaced relationship in said seal body, adjacent to said seal rim, bonding means to bond said seal rim to said tamper resistant bottle, a pull tab of string or other suitable material attached to said seal body, means adapted to bond said pull tab to said seal body, enabling said seal body to be detached from said seal rim at said perforations and withdrawn from said tamper resistant bottle.

7. A safety seal as described in claim 1 comprising a multilayered seal body, said seal body having a bottom layer of plastic or other impervious material, and whose diameter is greater than the other said layers, a middle layer containing a liquid dye, a top layer of paper, cloth or other suitable liquid absorbing material, means adapted to permanently bond said layers each to the other, a pull tab permanently bonded to said bottom layer, means adapted to bond said bottom layer to said configurations and projections in said tamper resistant bottle.

* * * * *